US011976347B2

(12) United States Patent
Whelchel et al.

(10) Patent No.: US 11,976,347 B2
(45) Date of Patent: May 7, 2024

(54) Al—Zn—Cu—Mg ALLOYS AND THEIR MANUFACTURING PROCESS

(71) Applicant: CONSTELLIUM ISSOIRE, Issoire (FR)

(72) Inventors: Ricky Whelchel, Athens, OH (US); Erembert Nizery, Grenoble (FR); Diana Koschel, Saint Jean de Moirans (FR); Jean-Christophe Ehrstrom, Grenoble (FR); Alireza Arbab, Rives-sur-Fure (FR)

(73) Assignee: CONSTELLIUM ISSOIRE (FR)

( * ) Notice: Subject to any disclaimer, the term of this patent is extended or adjusted under 35 U.S.C. 154(b) by 497 days.

(21) Appl. No.: 16/627,970

(22) PCT Filed: Jun. 28, 2018

(86) PCT No.: PCT/EP2018/067492

§ 371 (c)(1),
(2) Date: Dec. 31, 2019

(87) PCT Pub. No.: WO2019/007817

PCT Pub. Date: Jan. 10, 2019

(65) Prior Publication Data

US 2020/0131612 A1 Apr. 30, 2020

(30) Foreign Application Priority Data

Jul. 3, 2017 (FR) ..... 1756275

(51) Int. Cl.
*C22F 1/053* (2006.01)
*C22C 21/10* (2006.01)

(52) U.S. Cl.
CPC ..... *C22F 1/053* (2013.01); *C22C 21/10* (2013.01)

(58) Field of Classification Search
CPC ..... C22C 21/10; C22F 1/053
See application file for complete search history.

(56) References Cited

U.S. PATENT DOCUMENTS 6,972,110 B2 12/2005 Chakrabarti et al.
2005/0006010 A1* 1/2005 Benedictus ..... C22F 1/053 148/552

(Continued)

FOREIGN PATENT DOCUMENTS

AU 4751193 A 3/1994
AU B-47511/93 3/1994

(Continued)

OTHER PUBLICATIONS

Alloys, Wrought Aluminum, "International Alloy Designations and Chemical Composition Limits for Wrought Aluminum and Wrought Aluminum Alloys," Aluminum Association, (Jan. 2015).

(Continued)

*Primary Examiner* — Alexandra M Moore
*Assistant Examiner* — Austin Pollock
(74) *Attorney, Agent, or Firm* — McBee Moore & Vanik IP, LLC

(57) ABSTRACT

The invention concerns an extruded, rolled and/or forged aluminum-based alloy product having a thickness of at least 25 mm comprising (in weight %): Zn 6.70-7.40; Mg 1.50-1.80; Cu 2.20-2.60, with a Cu to Mg ratio of at least 1.30; Zr 0.04-0.14; Mn 0-0.5; Ti 0-0.15; V 0-0.15; Cr 0-0.25; Fe 0-0.15; Si 0-0.15; impurities ≤0.05 each and ≤0.15 total. The invention also concerns a method of making such a product. Products according to the invention are particularly advantageous because they exhibit simultaneously a low sensitivity to environmentally assisted cracking under conditions of high stress and humid environment, high strength and high toughness properties.

19 Claims, 1 Drawing Sheet

(56) References Cited

U.S. PATENT DOCUMENTS

| | | | | |
|---|---|---|---|---|
| 2005/0058568 | A1* | 3/2005 | Boselli | C22C 21/10 420/531 |
| 2005/0150578 | A1* | 7/2005 | Bes | C22C 21/10 148/439 |
| 2011/0150696 | A1 | 6/2011 | Brooks et al. | |

FOREIGN PATENT DOCUMENTS

| | | | | |
|---|---|---|---|---|
| CN | 102888575 | A * | 1/2013 | |
| CN | 103233148 | A * | 8/2013 | |
| EP | 0589807 | A1 | 3/1994 | |
| FR | 2853666 | A1 | 10/2004 | |
| WO | WO-2018237196 | A1 * | 12/2018 | C22C 21/10 |

OTHER PUBLICATIONS

American National Standards Institute, Aluminum Alloy Plate, 6.6Zn—1.8 Cu—2.0 Mg—0.10 Zr (7140-T7451) Solution Heat Treated, Stress Relieved, and Overaged (AMS 4401), Aerospace Material Specification, (Aug. 2006), 1-7.

American National Standards Institute, Aluminum Alloy Plate, 6.6Zn—1.8 Cu—2.0 Mg—0.10 Zr (7140-T7651) Solution Heat Treated, Stress Relieved, and Overaged (AMS 4408), Aerospace Material Specification, (May 2007), 1-7.

American National Standards Institute, Aluminum Alloy Plate, 6.6Zn—1.8 Cu—2.0 Mg≤0.10 Zr (7065-T7651) Solution Heat Treated, Stress Relieved, and Overaged (AMS 4351), Aerospace Material Specification, (Sep. 2014), 1-8.

American National Standards Institute, Aluminum Alloy Plate, 6.6Zn—1.8 Cu—2.0 Mg—0.10 Zr (7065-T7451) Solution Heat Treated, Stress Relieved, and Overaged (AMS 4361), Aerospace Material Specification, (Sep. 2014), 1-8.

American National Standards Institute, Heat Treatment if Aluminum Alloy Raw Materials (AMS 2772), Aerospace Material Specification, (Apr. 2016), 1-25.

European Aviation Safety Agency, "Environmentally Assisted Cracking in certain Aluminum Alloys," Safety Information Bulletin, Sep. 13, 2018.

Song R G et al: "Stress corrosion cracking and hydrogen embrittlement of an Al—Zn—Mg—Cu alloy", Acta Materia, Elsevier, Oxford, GB, vol. 52, No. 16, Sep. 20, 2004, pp. 4727-4743, XP004533289.

Search Report and Written Opinion of French Patent application No. 1756275 dated Jul. 3, 2017.

International Search Report of International Patent Application No. PCT/FR2018/067492 dated Jun. 28, 2018.

Aluminum Association: International Alloy Designation and Chemical Composition Limits for Wrought and Wrought Aluminum Alloys: "Teal Sheets", Aluminum Association, pp. 1-32, Jan. 2015.

SAE International, Aluminum Alloy, Plate (7140-T7451) 6.6Zn—1.8 Cu—2.0 Mg—0.10 Zr Solution Heat Treated, Stress-Relieved, and Overaged (AMS 4401), Aerospace Material Specification, pp. 1-7, Aug. 2006.

SAE International, Aluminum Alloy, Plate (7140-T7651) 6.6 Zn—1.8 Cu—2.0 Mg—0.10 Zr Solution Heat Treated, Stress-Relieved, and Overaged (AMS 4408), Aerospace Material Specification, pp. 1-7, May 2007.

SAE International; Aluminum Alloy, Plate (7065-T7651) 7.7Zn—2.1 Cu—1.65 Mg—0.10 Zr Solution Heat Treated, Stress-Relieved, and Overaged (AMS 4351), Aerospace Material Specification, pp. 1-8, Sep. 2014.

SAE International, Aluminum Alloy, Plate (7065-T7451) 7.7Zn—2.1 Cu—1.65 Mg—0.10 Zr Solution Heat Treated, Stress-Relieved, and Overaged (AMS 4361), Aerospace Material Specification, pp. 1-8, Sep. 2014.

SAE International; Heat Treatment of Aluminum Allow Raw Materials (AMS 2772); Aerospace Material Specification; pp. 1-25, Apr. 2016.

* cited by examiner

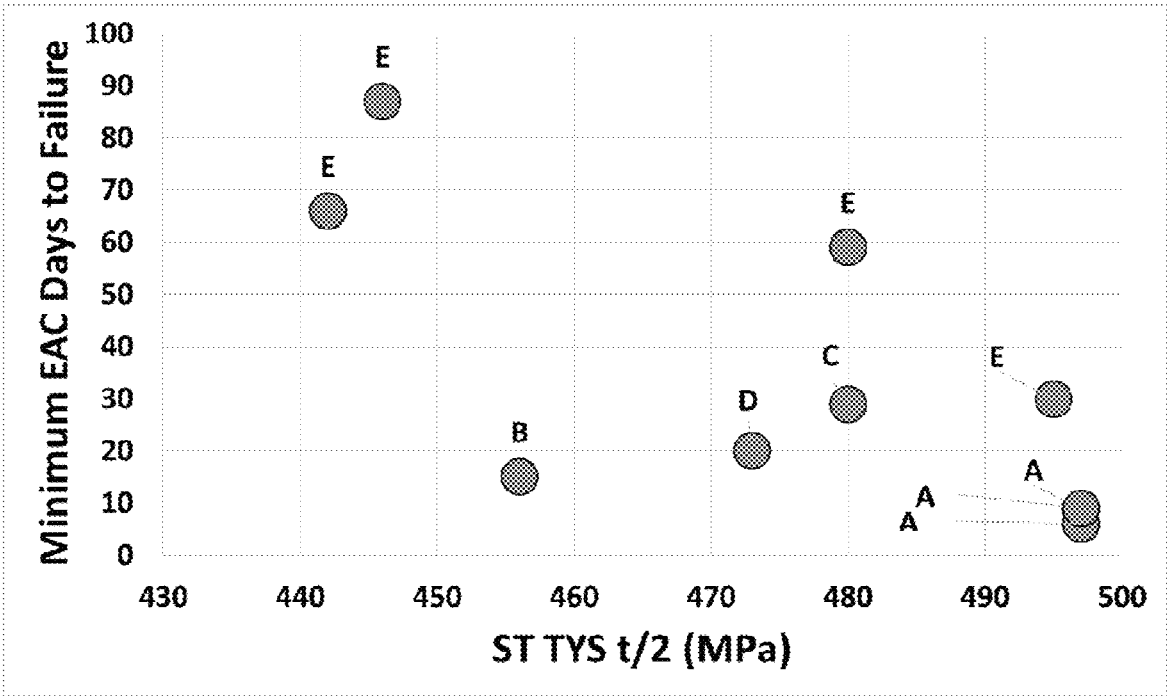
Minimum EAC Days to Failure
100
90
80
70
60
50
40
30
20
10
0
430
440
450
460
470
480
490
500
ST TYS t/2 (MPa)
E
E
E
C
E
D
B
A
A
A

Al—Zn—Cu—Mg ALLOYS AND THEIR MANUFACTURING PROCESS

CROSS-REFERENCE TO RELATED APPLICATIONS

This application is the National Stage entry of International Application No. PCT/EP2018/067492, filed 28 Jun. 2018, which claims priority to French Patent Application No. 1756275, filed 3 Jul. 2017.

BACKGROUND

Field of the Invention

The present invention relates generally to aluminum base alloys and more particularly, Al—Zn—Cu—Mg aluminum base alloys, in particular for aerospace applications.

Description of Related Art

Al—Zn—Cu—Mg aluminum base alloys have been used extensively in the aerospace industry for many years. With the evolution of airplane structures and efforts directed towards the goal of reducing both weight and cost, an optimum compromise between properties such as strength, toughness and corrosion resistance is continuously sought. Also, process improvement in casting, rolling and heat treatment can advantageously provide further control in the composition diagram of an alloy.

Thick rolled, forged or extruded products made of Al—Zn—Cu—Mg aluminum base alloys are used in particular to produce integrally machined high strength structural parts for the aeronautic industry, for example wing elements such as wing ribs, spars, frames and the like, which are typically machined from thick wrought sections.

The performance values obtained for various properties such as static mechanical strength, fracture toughness, resistance to corrosion, quench sensitivity, fatigue resistance, and level of residual stress will determine the overall performance of the product, the ability for a structural designer to use it advantageously, as well as the ease it can be used in further processing steps such as, for example, machining.

Among the above listed properties some are often conflicting in nature and a compromise generally has to be found. Conflicting properties are, for example, static mechanical strength versus toughness and strength versus resistance to corrosion.

Among corrosion or environmentally assisted cracking (EAC) properties, a distinction can be made between EAC under conditions of high stress and humid environment and EAC under conditions of standard stress corrosion cracking (SCC) tests, such as ASTM G47, where specimens are tested using alternate immersion and drying cycles with NaCl solution (ASTM G44) and typically using lower stress. Standard SCC failure can occur by a mixture of both anodic dissolution due to local potential differences and hydrogen embrittlement, whereas for EAC under conditions of high stress and humid environment hydrogen embrittlement is the most likely failure mode, (see for example J. R. SCULLY, G. A. YOUNG JR, S. W. SMITH, "Hydrogen embrittlement of aluminum and aluminum based alloys", in "Gaseous hydrogen embrittlement of materials in energy technologies, Edited by R. P. Glangloff and B. P. Somerday, Woodhead Publishing 2012, pp 707-768).

The development of a high strength 7XXX alloy that has low sensitivity to EAC under conditions of high stress and humid environment would be a significant improvement. In particular it is sought to obtain alloys with higher strength than known alloys such as AA7010 or AA7050 but exhibiting similar or higher resistance to EAC under conditions of high stress and humid environment.

Al—Zn—Mg—Cu alloys with high fracture toughness, high mechanical strength and high resistance to standard SCC are described in the prior art.

U.S. Pat. No. 5,312,498 discloses a method of producing an aluminum-based alloy product having improved exfoliation resistance and fracture toughness which comprises providing an aluminum-based alloy composition consisting essentially of about 5.5-10.0% by weight of zinc, about 1.75-2.6% by weight of magnesium, about 1.8-2.75% by weight of copper with the balance aluminum and other elements. The aluminum-based alloy is worked, heat treated, quenched and aged to produce a product having improved corrosion resistance and mechanical properties. The amounts of zinc, magnesium and copper are stoichiometrically balanced such that after precipitation is essentially complete as a result of the aging process, no excess elements are present.

U.S. Pat. No. 5,560,789 describes AA 7000 series alloys having high mechanical strength and a process for obtaining them. The alloys contain, by weight, 7 to 13.5% Zn, 1 to 3.8% Mg, 0.6 to 2.7% Cu, 0 to 0.5% Mn, 0 to 0.4% Cr, 0 to 0.2% Zr, others up to 0.05% each and 0.15% total, and remainder Al, corrosion properties are however not mentioned.

U.S. Pat. No. 5,865,911 describes an aluminum alloy consisting essentially of (in weight %) about 5.9 to 6.7% zinc, 1.8 to 2.4% copper, 1.6 to 1.86% magnesium, 0.08 to 0.15% zirconium balance aluminum and incidental elements and impurities. The '911 patent particularly mentions the compromise between static mechanical strength and toughness.

U.S. Pat. No. 6,027,582 describes a rolled, forged or extruded Al—Zn—Mg—Cu aluminum base alloy products greater than 60 mm thick with a composition of (in weight %), Zn: 5.7-8.7, Mg: 1.7-2.5, Cu: 1.2-2.2, Fe: 0.07-0.14, Zr: 0.05-0.15 with Cu+Mg<4.1 and Mg>Cu. The '582 patent also describes improvements in quench sensitivity.

U.S. Pat. No. 6,972,110 teaches an alloy, which contains preferably (in weight %) Zn: 7-9.5, Mg: 1.3-1.68 and Cu 1.3-1.9 and encourages keeping Mg+Cu≤3.5. The '110 patent discloses using a three step aging treatment in order to improve resistance to stress corrosion cracking. A three step aging is long and difficult to master and it would be desirable to obtain high corrosion resistance without necessarily requiring such a thermal treatment.

PCT Patent application No WO2004090183 discloses an alloy comprising essentially (in weight percent): Zn: 6.0-9.5, Cu: 1.3-2.4, Mg: 1.5-2.6, Mn and Zr<0.25 but preferably in a range between 0.05 and 0.15 for higher Zn contents, other elements each less than 0.05 and less than 0.25 in total, balance aluminium, wherein (in weight percent): 0.1[Cu]+1.3<[Mg]<0.2[Cu]+2.15, preferably 0.2[Cu]+1.3<[Mg]<0.1[Cu]+2.15.

US Patent application No 2005/006010 a method for producing a high strength Al—Zn—Cu—Mg alloy with an improved fatigue crack growth resistance and a high damage tolerance, comprising the steps of casting an ingot with the following composition (in weight percent) Zn 5.5-9.5, Cu 1.5-3.5, Mg 1.5-3.5, Mn<0.25, Zr<0.25, Cr<0.10, Fe<0.25, Si<0.25, Ti<0.10, Hf and/or V<0.25, other elements each less than 0.05 and less than 0.15 in total, balance aluminum, homogenizing and/or pre-heating the ingot after casting, hot working the ingot and optionally cold working into a worked product of more than 50 mm thickness, solution heat treating, quenching the heat treated product, and artificially ageing the worked and heat-treated product, wherein the ageing step comprises a first heat treatment at a temperature in a range of 105° C. to 135° C. for more than 2 hours and less than 8 hours and a second heat treatment at a higher temperature than 135° C. but below 170° C. for more than 5 hours and less than 15 hours. Again, such three step aging is long and difficult to master.

EP Patent 1 544 315 discloses a product, especially rolled, extruded or forged, made of an AlZnCuMg alloy with constituents having the following percentage weights: Zn 6.7-7.3; Cu 1.9-2.5; Mg 1.0-2.0; Zr 0.07-0.13; Fe less than 0.15; Si less than 0.15; other elements not more than 0.05 to at most 0.15 percent in total; and aluminum the remainder. The product is preferably treated by solution heat treatment, quenching, cold working and artificial aging.

U.S. Pat. No. 8,277,580 teaches a rolled or forged Al—Zn—Cu—Mg aluminum-based alloy wrought product having a thickness from 2 to 10 inches. The product has been treated by solution heat-treatment, quenching and aging, and the product comprises (in weight-%): Zn 6.2-7.2, Mg 1.5-2.4, Cu 1.7-2.1. Fe 0-0.13, Si 0-0.10, Ti 0-0.06, Zr 0.06-0.13, Cr 0-0.04, Mn 0-0.04, impurities and other incidental elements <=0.05 each.

U.S. Pat. No. 8,673,209 discloses aluminum alloy products about 4 inches thick or less that possesses the ability to achieve, when solution heat treated, quenched, and artificially aged, and in parts made from the products, an improved combination of strength, fracture toughness and corrosion resistance, the alloy consisting essentially of: about 6.8 to about 8.5 wt. % Zn, about 1.5 to about 2.00 wt. % Mg, about 1.75 to about 2.3 wt. % Cu; about 0.05 to about 0.3 wt. % Zr, less than about 0.1 wt. % Mn, less than about 0.05 wt. % Cr, the balance Al, incidental elements and impurities and a method for making same.

The effect of 7XXX alloy composition on SCC resistance has been recently reviewed (N. J. Henry Holroyd and G. M. Scamans, "Stress Corrosion Cracking in Al—Zn—Mg—Cu Aluminum Alloys in Saline Environments," *Metall. Mater. Trans. A, vol.* 44, pp. 1230-1253, 2013.). It was concluded that SCC growth rates at room temperature for peak and over-aged tempers in saline environments are minimized for Al—Zn—Mg—Cu alloys containing less than 8 wt. % Zn when Zn/Mg ratios are ranging from 2 to 3, excess magnesium compared to stoichimetric levels are less than 1 wt. % and copper content is either less than 0 0.2 wt. % or ranging from 1.3 to 2 wt. %.

None of the documents, which describe high strength 7xxx alloy products, describe alloy products with low sensitivity to EAC under conditions of high stress and humid environment and having simultaneously high strength and high toughness properties.

SUMMARY OF THE INVENTION

An object of the invention was to provide an Al—Zn—Cu—Mg alloy having a specific composition range that enables, for wrought products, an improved compromise among mechanical strength for an appropriate level of fracture toughness and resistance to EAC under conditions of high stress and humid environment.

Another object of the invention was the provision of a manufacturing process of wrought aluminum products which enables an improved compromise among mechanical strength for an appropriate level of fracture toughness and resistance to EAC under conditions of high stress and humid environment.

To achieve these and other objects, the present invention is directed to an extruded, rolled and/or forged aluminum-based alloy product having a thickness of at least 25 mm comprising, or advantageously consisting of (in weight %):

Zn 6.70-7.40
Mg 1.50-1.80
Cu 2.20-2.60, wherein the Cu to Mg ratio is at least 1.30
Zr 0.04-0.14
Mn 0-0.5
Ti 0-0.15
V 0-0.15
Cr 0-0.25
Fe 0-0.15
Si 0-0.15
impurities ≤0.05 each and ≤0.15 total.

The present invention is also directed to a process for the manufacture of an extruded, rolled and/or forged aluminum-based alloy product comprising the steps of:

a) casting an ingot or billet comprising, or advantageously consisting essentially of (in weight-%)
   Zn 6.70-7.40
   Mg 1.50-1.80
   Cu 2.20-2.60, wherein the Cu to Mg ratio is at least 1.30
   Zr 0.04-0.14
   Mn 0-0.5
   Ti 0-0.15
   V 0-0.15
   Cr 0-0.25
   Fe 0-0.15
   Si 0-0.15
   impurities ≤0.05 each and ≤0.15 total.
b) homogenizing the ingot or billet
c) hot working said homogenized ingot or billet to an extruded, rolled and/or forged product with a final thickness of at least 25 mm;
d) solution heat treating and quenching the product;
e) stretching the product;
f) artificial aging

BRIEF DESCRIPTION OF THE DRAWINGS

FIG. 1: Relationship between Average EAC days to failure and ST TYS for the alloys of the example.

DETAILED DESCRIPTION

Unless otherwise indicated, all the indications relating to the chemical composition of the alloys are expressed as a mass percentage by weight based on the total weight of the alloy. In the expression Cu/Mg, Cu means the Cu content in weight % and Mg means the Mg content in weight %. Alloy designation is in accordance with the regulations of The Aluminium Association, known to those skilled in the art. The definitions of tempers are laid down in EN 515 (1993).

Unless mentioned otherwise, static mechanical characteristics, i.e., the ultimate tensile strength UTS, the tensile yield stress TYS and the elongation at fracture E, are determined by a tensile test according to standard NF EN ISO 6892-1 (2016), the location at which the pieces are taken and their direction being defined in standard EN 485 (2016).

Unless otherwise specified, the definitions of standard EN 12258 apply.

The thickness of the extruded products is defined according to standard EN 2066:2001: the cross-section is divided into elementary rectangles of dimensions A and B; A always being the largest dimension of the elementary rectangle and B being regarded as the thickness of the elementary rectangle. The bottom is the elementary rectangle with the largest dimension A.

The fracture toughness $K_{1C}$ is determined according to ASTM standard E399 (2012). A plot of the stress intensity versus crack extension, known as the R curve, is determined according to ASTM standard E561 (2015). The critical stress intensity factor $K_C$, in other words the intensity factor that makes the crack unstable, is calculated starting from the R curve. The stress intensity factor $K_{CO}$ is also calculated by assigning the initial crack length to the critical load, at the beginning of the monotonous load. These two values are calculated for a test piece of the required shape. $K_{app}$ denotes the $K_{CO}$ factor corresponding to the test piece that was used to make the R curve test.

It should be noted that the width of the test specimen used in a toughness test could have a substantial influence on the critical stress intensity factor measured in the test. CT-specimens were used. The width W was unless otherwise mentioned 5 inch (127 mm) with B=0.3 inch and the initial crack length ao=1.8 inch. The measurement were done at half thickness.

Except if mentioned otherwise, EAC under conditions of high stress and humid environment was tested under a constant strain on a tensile sample at mid-thickness as described in standard ASTM G47 and using a load of about 80% of ST direction TYS, under 85% relative humidity, and at a temperature of 70° C. The minimum life without failure after Environmentally Assisted Cracking (EAC) corresponds to the minimum number of days to failure from 3 specimens for each plate.

The term "structural member" is a term well known in the art and refers to a component used in mechanical construction for which the static and/or dynamic mechanical characteristics are of particular importance with respect to structure performance, and for which a structure calculation is usually prescribed or undertaken. These are typically components the rupture of which may seriously endanger the safety of the mechanical construction, its users or third parties. In the case of an aircraft, structural members comprise members of the fuselage (such as fuselage skin), stringers, bulkheads, circumferential frames, wing components (such as wing skin, stringers or stiffeners, ribs, spars), empennage (such as horizontal and vertical stabilisers), floor beams, seat tracks, and doors.

The alloy of the invention has a specific composition which makes it possible to obtain products insensitive to EAC under conditions of high stress and humid environment and having simultaneously high strength and high toughness properties.

A minimum Zn content of 6.70 and preferably 6.80 or even 6.90 is needed to obtain sufficient strength. However the Zn content should not exceed 7.40 and preferably 7.30 to obtain the sought balance of properties, in particular toughness and elongation. In an embodiment the Zn maximum content is 7.20.

A minimum Mg content of 1.50 and preferably 1.55 or even 1.60 is needed to obtain sufficient strength. However the Mg content should not exceed 1.80 and preferably 1.75 to obtain the sought balance of properties in particular toughness and elongation and avoid quench sensitivity. In an embodiment the Mg maximum content is 1.70.

In an embodiment the Zn content is from 6.90 to 7.20 wt. % and the Mg content is from 1.60 to 1.70 wt. %.

A minimum Cu content of 2.20 and preferably 2.25 or 2.30, or even 2.35 is needed to obtain sufficient strength and to obtain sufficient EAC performance. However the Cu content should not exceed 2.60 and preferably 2.55 in particular to avoid quench sensitivity. In an embodiment the Cu maximum content is 2.50.

In order to obtain products with low sensitivity to EAC under conditions of high stress and humid environment, the Cu/Mg ratio is carefully controlled to at least 1.30. A minimum Cu/Mg ratio of 1.35 or preferably 1.40 is advantageous. In an embodiment the maximum Cu/Mg ratio is 1.70 and preferably 1.65.

A minimum level of solutes (Zn, Mg and Cu) is preferred to obtain the desired strength. Zn+Cu+Mg is preferably at least 10.7 wt. % and preferentially at least 11.0 wt. % and even more preferentially at least 11.1 wt. %. Similarly, Cu+Mg is preferably at least 3.8 wt. % and preferentially at least 3.9 wt. %. In a embodiment Zn+Cu+Mg is at least 11.2 wt. % and Cu+Mg is at least 4.0 wt. %.

High content of Mg and Cu may increase quench sensitivity and affect fracture toughness performance. The combined content of Mg and Cu should preferably be maintained below 4.3 wt. % and preferentially below 4.2 wt. %.

The Zn/Mg ratios of the products of the invention are from 3.7 to 4.9 (precisely from 6.70/1.80=3.72 to 7.40/1.50=4.93) which is surprising in view of the teaching of Holroyd Scamans who teach from 2 to 3. Preferably the Zn/Mg ratios of the products of the invention are from 4.0 to 4.6.

The alloys of the present invention further contains 0.04 to 0.14 wt. % zirconium, which is typically used for grain size control. The Zr content should preferably comprise at least about 0.07 wt. %, and preferentially about 0.09 wt. % in order to affect the recrystallization, but should advantageously remain below about 0.12 wt. % in order to reduce problems during casting.

Titanium, associated with either boron or carbon can usually be added if desired during casting in order to limit the as-cast grain size. The present invention may typically accommodate up to about 0.06 wt. % or about 0.05 wt. % Ti. In a preferred embodiment of the invention, the Ti content is about 0.02 wt. % to about 0.06 wt. % and preferentially about 0.03 wt. % to about 0.05 wt. %.

Manganese, may be added up to about 0.5 wt. %. In an embodiment the Mn content is from 0.2 to 0.5 wt. %. However manganese is preferentially avoided and is generally kept below about 0.04 wt. % and preferentially below about 0.03 wt. %.

Vanadium, may be added up to about 0.15 wt. %. In an embodiment the V content is from 0.05 to 0.15 wt. %. However vanadium is preferentially avoided and is generally kept below about 0.04 wt. % and preferentially below about 0.03 wt. %.

Chromium, may be added up to about 0.25 wt. %. In an embodiment the Cr content is from 0.15 to 0.25 wt. %. However chromium is preferentially avoided and is generally kept below about 0.04 wt. % and preferentially below about 0.03 wt. %.

The present alloy can further contain other elements to a lesser extent and in some embodiments, on a less preferred basis. Iron and silicon typically affect fracture toughness properties. Iron and silicon content should generally be kept low, with a content of at most 0.15 wt. %, and preferably not exceeding about 0.13 wt. % or preferentially about 0.10 wt. % for iron and preferably not exceeding about 0.10 wt. % or preferentially about 0.08 wt. % for silicon. In one embodiment of the present invention, iron and silicon content are ≤0.07 wt. %.

Other elements are impurities which should have a maximum content of 0.05 wt. % each and ≤0.15 total, preferably a maximum content of 0.03 wt. % each and ≤0.10 total.

A suitable process for producing wrought products according to the present invention comprises: (i) casting an ingot or a billet made in an alloy according to the invention, (ii) conducting an homogenization of the ingot or billet preferably with at least one step at a temperature from about 460 to about 510° C. or preferentially from about 470 to about 500° C. typically for 5 to 30 hours, (iii) conducting hot working of said homogenized ingot or billet in one or more stages by extruding, rolling and/or forging, with an entry temperature preferably comprised from about 380 to about 460° C. and preferentially between about 400 and about 450° C., to an extruded, rolled and/or forged product with a final thickness of at least 25 mm, (iv) conducting a solution heat treatment preferably at a temperature from 460 to about 510° C. or preferentially from about 470 to about 500° C. typically for 1 to 10 hours depending on thickness, (v) conducting a quench, preferentially with room temperature water, (vi) conducting stress relieving by controlled stretching or compression with a permanent set of preferably less than 5% and preferentially from 1 to 4%, and, (vii) conducting an artificial aging treatment.

The present invention finds particular utility in thick gauges of greater than about 25 mm. In a preferred embodiment, a wrought product of the present invention is a plate having a thickness from 25 to 200 mm, or advantageously from 50 to 150 mm comprising an alloy according to the present invention. "Over-aged" tempers ("T7 type") are advantageously used in order to improve corrosion behavior in the present invention. Tempers that can suitably be used for the products according to the invention, include, for example T6, T651, T73, T74, T76, T77, T7351, T7451, T7452, T7651, T7652 or T7751, the tempers T7351, T7451 and T7651 being preferred. Aging treatment is advantageously carried out in two steps, with a first step at a temperature comprised between 110 and 130° C. for 3 to 20 hours and preferably for 4 or 5 to 12 hours and a second step at a temperature comprised between 140 and 170° C. and preferably between 150 and 165° C. for 5 to 30 hours.

In an advantageous embodiment, the equivalent aging time t(eq) at 155° C. is comprised between 8 and 35 or 30 hours and preferentially between 12 and 25 hours. The equivalent time t(eq) at 155° C. being defined by the formula:

$$t(eq) = \frac{\int \exp(-16000/T)dt}{\exp(-16000/T_{ref})}$$

where T is the instantaneous temperature in ° K during annealing and $T_{ref}$ is a reference temperature selected at 155° C. (428° K). t(eq) is expressed in hours.

The narrow composition range of the alloy from the invention, selected mainly for a strength versus toughness compromise provided wrought products with unexpectedly high EAC performance under conditions of high stress and humid environment.

Thus a product according to the invention has preferably the following properties:

a) a minimum life without failure after Environmentally Assisted Cracking (EAC) under conditions of high stress, at a short transverse (ST) stress level of 80% of the product tensile yield strength in ST direction, and humid environment with 85% relative humidity at a temperature of 70° C., of at least 30 days and preferably of at least 40 days, b) a conventional tensile yield strength measured in the L direction at quarter thickness of at least 515−0.279*t MPa and preferably of 525−0.279*t MPa and even more preferably of 535−0.279*t MPa (t being the thickness of the product in mm), c) a $K_{1C}$ toughness in the L-T direction measured at quarter thickness of at least 42−0.1 t MPa√m and preferably 44−0.1 t MPa√m and even more preferably 47−0.1 t MPa√m (t being the thickness of the product in mm).

Preferably the minimum life without failure after Environmentally Assisted Cracking under said conditions of high stress and humid environment is of at least 50 days, more preferably of at least 70 days and preferentially of at least 90 days at a short transverse (ST) direction.

In an embodiment the conditions of high stress comprise a short transverse (ST) stress level of 380 MPa.

Wrought products according to the present invention are advantageously used as or incorporated in structural members for the construction of aircraft.

In an advantageous embodiment, the products according to the invention are used in wing ribs, spars and frames. In embodiments of the invention, the wrought products according to the present invention are welded with other wrought products to form wing ribs, spars and frames.

These, as well as other aspects of the present invention, are explained in more detail with regard to the following illustrative and non-limiting examples.

EXAMPLE

Example 1

Five ingots were cast, one of a product according to the invention (E), and four reference examples with the following composition (Table 1):

TABLE 1 composition (wt. %) of cast according to the invention and of reference casts.

| Alloy | Si | Fe | Cu | Mg | Zn | Ti | Zr |
|---|---|---|---|---|---|---|---|
| A | 0.044 | 0.073 | 1.93 | 2.16 | 8.45 | 0.017 | 0.11 |
| B | 0.037 | 0.066 | 1.59 | 1.85 | 6.34 | 0.037 | 0.11 |
| C | 0.029 | 0.03 | 2.11 | 1.69 | 7.24 | 0.041 | 0.10 |
| D | 0.035 | 0.052 | 2.14 | 1.66 | 7.20 | 0.03 | 0.10 |
| E | 0.027 | 0.046 | 2.49 | 1.66 | 7.09 | 0.030 | 0.09 |

The ingots were then scalped and homogenized at 473° C. (alloy A) or 479° C. (alloys B to E). The ingots were hot rolled to a plate of thickness of 120 mm (alloy A) or 76 mm (alloys B to E). Hot rolling entry temperature was between 400° C. and 440° C. The plates were solution heat treated with a soak temperature of 473° C. (alloy A) or 479° C. (alloys B to E). The plates were quenched and stretched with a permanent elongation comprised between 2.0 and 2.5%.

The reference plates were submitted to a two step aging of 6 hours at 120° C. followed by approximately 10 hours at 160° C. (alloy A) or approximately 15 hours at 155° C. (alloys B to D), for a total equivalent time at 155° C. of 17 hours, to obtain a T7651 temper. The invention plates E were submitted to a two step aging of 4 hours at 120° C. followed by approximately 15, 20, 24 and 32 hours at 155° C., for a total equivalent time at 155° C. of 17, 22, 27 and 35 hours, respectively.

All the samples tested were substantially unrecrystallized, with a volume fraction of recrystallized grains lower than 35%.

The samples were mechanically tested, at quarter-thickness for L and LT directions and at mid-thickness for ST direction to determine their static mechanical properties as well as their fracture toughness. Tensile yield strength, ultimate strength and elongation at fracture are provided in Table 2.

TABLE 2

| Static mechanical properties of the samples | | | | | | | | | | |
|---|---|---|---|---|---|---|---|---|---|---|
| | | L Direction | | | LT Direction | | | ST Direction | | |
| Alloy | Aging* | UTS (MPa) | TYS (MPa) | E (%) | UTS (MPa) | TYS (MPa) | E (%) | UTS (MPa) | TYS (MPa) | E (%) |
| A | 17 | 562 | 524 | 9.1 | 558 | 513 | 4.8 | 530 | 497 | 0.6 |
| B | 17 | 513 | 489 | 16.3 | 538 | 488 | 13.0 | 522 | 456 | 8.5 |
| C | 17 | 547 | 519 | 14.0 | 552 | 509 | 14.0 | 539 | 480 | 6.8 |
| D | 17 | 548 | 517 | 15.0 | 544 | 503 | 14.0 | 531 | 473 | 8.5 |
| E | 17 | 558 | 537 | 12.9. | 566 | 524 | 9.9. | 553 | 495 | 5.7. |
| E | 22 | 545 | 515 | 13.6 | 556 | 507 | 10.9 | 542 | 480 | 6.7 |
| E | 27 | 524 | 479 | 13.9 | 528 | 473 | 10.0 | 515 | 442 | 7.8 |
| E | 35 | 516 | 473 | 13.6 | 526 | 471 | 10.5 | 515 | 446 | 7.9 |

*total equivalent time at 155° C. (h)

The sample according to the invention exhibits similar strength compared to comparative examples A, C and D. Compared to alloy B, the improvement is more than 5%. Comparatively to 7050 plates, the improvement in tensile yield strength in the L-direction is higher than 10%.

Results of the fracture toughness testing are provided in Table 3.

TABLE 3

| Fracture toughness properties of the samples | | | | | | |
|---|---|---|---|---|---|---|
| | | $K_{1C}$ | | | $K_{app}$ | |
| Alloy | Aging* | L-T (MPa√m) | T-L (MPa√m) | S-L (MPa√m) | L-T (MPa√m) | T-L (MPa√m) |
| A | 17 | 29.5 | 22.8 | 22.6 | | |
| B | 17 | 44.0 | 34.4 | 30.7 | | |
| C | 17 | 43.2 | 37.6 | 42.0 | 95.7 | 67.7 |
| D | 17 | 44.2 | 36.9 | 38.0 | 95.5 | 71.3 |
| E | 17 | 38.2 | 30.8 | | 114.7 | 62.5 |

TABLE 3-continued

| Fracture toughness properties of the samples | | | | | | |
|---|---|---|---|---|---|---|
| | | $K_{1C}$ | | | $K_{app}$ | |
| Alloy | Aging* | L-T (MPa√m) | T-L (MPa√m) | S-L (MPa√m) | L-T (MPa√m) | T-L (MPa√m) |
| E | 22 | 40.2 | 32.6 | | | |
| E | 27 | 45.1 | 34.1 | | | |
| E | 35 | 51.1 | 37.7 | | | |

*total equivalent time at 155° C. (h)

EAC under conditions of high stress and humid environment was measured with ST direction tensile specimens which are described in ASTM G47. Testing stress and environment were different from ASTM G47 and used a load of about 80% of ST direction TYS at t/2, under 85% relative humidity, and at a temperature of 70° C. The number of days to failure is provided for 3 specimens for each plate.

The results are provided in Table 4

TABLE 4

| Results of EAC under conditions of high stress and humid environment | | | | | | | |
|---|---|---|---|---|---|---|---|
| | | ST TYS t/2 | EAC Stress | Test | Number of Days to Failure | | |
| Alloy | Aging* | (MPa) | (MPa) | Method | Sample 1 | Sample 2 | Sample 3 |
| A | 17 | 497 | 384 | Constant Strain | 6 | 12 | 13 |
| | | 497 | 407 | Constant Strain | 9 | 9 | 9 |
| | | 497 | 407 | Constant Load | 9 | 9 | 13 |
| B | 17 | 456 | 365 | Constant Strain | 15 | 25 | 32 |
| C | 17 | 480 | 384 | Constant Strain | 29 | 29 | 43 |
| D | 17 | 473 | 378 | Constant Strain | 20 | 27 | 39 |
| E | 17 | 495 | 421 | Constant Load | 30 | 31 | 48 |
| E | 22 | 480 | 408 | Constant Load | 59 | 85 | 125 |
| E | 27 | 442 | 375 | Constant Load | 66 | 80 | 150 |
| E | 35 | 446 | 379 | Constant Load | 92 | 87 | 154 |

*total equivalent time at 155° C. (h)

The resistance to EAC under conditions of high stress and humid environment of alloy E (inventive) plate in the short transverse direction was surprisingly high with an improvement of the minimum EAC life of more than about 30 days compared to the reference examples (C & D) for essentially the same TYS value. The inventive alloy E exhibited outstanding EAC performance under conditions of high stress and humid environment compared to known prior art. It was particularly impressive and unexpected that a plate according to the present invention exhibited a higher level of EAC resistance simultaneously with a comparable tensile strength and fracture toughness compared to prior art samples.

Example 2

Three ingots were cast according to the invention with the composition F (Table 5):

TABLE 5 composition (wt. %) of cast according to the invention and of reference casts.

| Alloy | Si | Fe | Cu | Mg | Zn | Ti | Zr |
|---|---|---|---|---|---|---|---|
| F | 0.026 | 0.045 | 2.46 | 1.63 | 7.030 | 0.030 | 0.10 |

The ingots were then scalped and homogenized at 479° C. The ingots were hot rolled to a plate of thickness of 51 mm, 102 mm and 152 mm, respectively. Hot rolling entry temperature was about 400° C. The plates were solution heat treated with a soak temperature of 479° C. The plates were quenched and stretched with a permanent elongation comprised between 2.0 and 2.5%.

The plates were submitted to a two step aging of 4 hours at 120° C. followed by approximately 15, 20, 24 and 32 hours at 155° C., for a total equivalent time at 155° C. of 17, 22, 27 and 35 hours, respectively.

All the samples tested were substantially unrecrystallized, with a volume fraction of recrystallized grains lower than 35%.

The samples were mechanically tested, at quarter-thickness for L and LT directions and at mid-thickness for ST direction to determine their static mechanical properties as well as their fracture toughness, except for fracture toughness measurement of the plate of thickness 51 mm where all directions were tested at mid-thickness. Tensile yield strength, ultimate strength and elongation at fracture are provided in Table 6.

TABLE 6

Static mechanical properties of the samples

| | | L Direction | | | LT Direction | | | ST Direction | | |
|---|---|---|---|---|---|---|---|---|---|---|
| Thickness (mm) | Aging* | UTS (MPa) | TYS (MPa) | E (%) | UTS (MPa) | TYS (MPa) | E (%) | UTS (MPa) | TYS (MPa) | E (%) |
| 51 | 17 | 575 | 547 | 13.5 | 572 | 538 | 11.9 | 556 | 497 | 7.5 |
| 51 | 22 | 557 | 527 | 14.2 | 560 | 521 | 11.3 | 552 | 482 | 7.9 |
| 51 | 27 | 539 | 499 | 13.8 | 538 | 486 | 11.7 | 535 | 465 | 8.6 |
| 51 | 35 | 533 | 486 | 13.6 | 535 | 482 | 13.1 | 532 | 462 | 9.0 |
| 102 | 17 | 544 | 520 | 13.0 | 556 | 516 | 9.4 | 540 | 480 | 6.1 |
| 102 | 22 | 534 | 504 | 13.7 | 543 | 490 | 9.4 | 531 | 469 | 6.3 |
| 102 | 27 | 513 | 474 | 12.8 | 516 | 458 | 10.2 | 508 | 440 | 7.2 |
| 102 | 35 | 501 | 456 | 13.2 | 518 | 459 | 9.5 | 503 | 429 | 8.0 |
| 152 | 17 | 526 | 499 | 11.1 | 541 | 483 | 7.5 | 521 | 465 | 5.7 |
| 152 | 22 | 516 | 486 | 11.3 | 530 | 470 | 7.2 | 515 | 449 | 6.1 |
| 152 | 27 | 499 | 459 | 11.3 | 511 | 441 | 8.1 | 491 | 418 | 7.0 |
| 152 | 35 | 488 | 441 | 11.2 | 500 | 431 | 8.0 | 486 | 406 | 7.0 |

*total equivalent time at 155° C. (h)

Results of the fracture toughness testing are provided in Table 7.

TABLE 7

Fracture toughness properties of the samples

| | | $K_{1C}$ | | |
|---|---|---|---|---|
| Thickness | Aging* | L-T (MPa√m) | T-L (MPa√m) | S-L (MPa√m) |
| 51 | 17 | 48.4 | 35.4 | 38.8 |
| 51 | 22 | 50.1 | 39.5 | 39.4 |
| 51 | 27 | 56.9 | 42.3 | 40.8 |
| 51 | 35 | 61.5 | 44.1 | 47.1 |
| 102 | 17 | 38.5 | 30.1 | 33.2 |
| 102 | 22 | 41.8 | 34.8 | 35.5 |
| 102 | 27 | 45.3 | 36.4 | 40.3 |
| 102 | 35 | 52.9 | 38.0 | 41.0 |
| 152 | 17 | 33.9 | 27.5 | 28.8 |
| 152 | 22 | 35.9 | 28.3 | 31.4 |
| 152 | 27 | 31.4 | 39.8 | 35.5 |
| 152 | 35 | 33.3 | 41.3 | 38.5 |

*total equivalent time at 155° C. (h)

EAC under conditions of high stress and humid environment was measured with ST direction tensile specimens which are described in ASTM G47 under constant load. Testing stress and environment were different from ASTM G47 and used a load of about 80% of ST direction TYS at t/2, under 85% relative humidity, and at a temperature of 70° C. The number of days to failure is provided for 3 specimens for each plate.

The results are provided in Table 8

TABLE 8

Results of EAC under conditions of high stress and humid environment

| | | ST TYS | EAC | Number of Days to Failure | | |
|---|---|---|---|---|---|---|
| Thickness | Aging* | t/2 (MPa) | Stress (MPa) | Sample 1 | Sample 2 | Sample 3 |
| 51 | 17 | 497 | 422 | 12 | 21 | 159 |
| 51 | 22 | 482 | 410 | 14 | 34 | 159 |

TABLE 8-continued

| Results of EAC under conditions of high stress and humid environment | | | | | | |
|---|---|---|---|---|---|---|
| | | ST TYS | EAC | Number of Days to Failure | | |
| Thickness | Aging* | t/2 (MPa) | Stress (MPa) | Sample 1 | Sample 2 | Sample 3 |
| 51 | 27 | 465 | 395 | 14 | 67 | 125 |
| 51 | 35 | 462 | 392 | 36 | 46 | 47 |
| 102 | 17 | 480 | 408 | 70 | 86 | ≥160 |
| 102 | 22 | 469 | 399 | 85 | 93 | 103 |
| 102 | 27 | 440 | 374 | 75 | 145 | ≥160 |
| 102 | 35 | 429 | 365 | 125 | ≥160 | ≥160 |
| 152 | 17 | 465 | 395 | ≥160 | ≥160 | ≥160 |
| 152 | 22 | 449 | 381 | ≥160 | ≥160 | ≥160 |
| 152 | 27 | 418 | 355 | ≥160 | ≥160 | ≥160 |
| 152 | 35 | 406 | 345 | ≥160 | ≥160 | ≥160 |

*total equivalent time at 155° C. (h)

The resistance to EAC under conditions of high stress and humid environment of alloy F (inventive) plate in the short transverse direction is surprisingly high a minimum life without failure of 30 days for each thickness and even of 160 days for the thickness 152 mm.

All documents referred to herein are specifically incorporated herein by reference in their entireties.

As used herein and in the following claims, articles such as "the", "a" and "an" can connote the singular or plural.

In the present description and in the following claims, to the extent a numerical value is enumerated, such value is intended to refer to the exact value and values close to that value that would amount to an insubstantial change from the listed value.

The invention claimed is:

1. An extruded, rolled and/or forged aluminum-based alloy product having a thickness of at least 25 mm comprising (in weight %):

Zn 6.70-7.40
Mg 1.50-1.80
Cu 2.35-2.55, wherein the Cu to Mg ratio is at least 1.30, wherein Cu+Mg is at least 3.8 wt. %,
Zr 0.04-0.14
Mn 0.2-0.5
Ti 0-0.15
V 0-0.15
Fe 0-0.15
Si 0-0.15
impurities ≤0.05 each and ≤0.15 total, and
wherein the alloy product does not contain Cr,
wherein said product has the following properties:

a) minimum life without failure after Environmentally Assisted Cracking (EAC) under conditions of high stress, at a short transverse (ST) stress level of 80% of the product tensile yield strength in ST direction, and humid environment with 85% relative humidity at a temperature of 70° C., of at least 30 days,
b) conventional tensile yield strength measured in the L direction at quarter thickness of at least 515-0.279*t MPa (t being the thickness of the product in mm),
c) $K_{1C}$ toughness in the L-T direction measured at quarter thickness of at least 42-0.1 t MPa√m (t being the thickness of the product in mm).

2. The product according to claim 1, wherein the maximum Cu/Mg ratio is 1.70.

3. The product according to claim 1, wherein the Cu/Mg ratio is from 1.35 to 1.65.

4. The product according to claim 1, wherein a Zn/Mg ratio is from 4.0 to 4.6.

5. The product according to claim 1, wherein Zn+Cu+Mg is at least 10.7 wt. %.

6. The product according to claim 1, wherein Zn+Cu+Mg is at least 11.2 wt. % and Cu+Mg is at least 4.0 wt. %.

7. The product according to claim 1 wherein the thickness thereof is from 25 to 200 mm.

8. The product according to claim 1 wherein the thickness thereof is from 50 to 150 mm.

9. The product according to claim 1, wherein said product has the following properties:

a) a minimum life without failure after Environmentally Assisted Cracking (EAC) under conditions of high stress, at a short transverse (ST) stress level of 80% of the product tensile yield strength in ST direction, and humid environment with 85% relative humidity at a temperature of 70° C., of at least 40 days,
b) a conventional tensile yield strength measured in the L direction at quarter thickness of at least 535-0.279*t MPa (t being the thickness of the product in mm),
c) a $K_{1C}$ toughness in the L-T direction measured at quarter thickness of at least 47-0.1 t MPa√m (t being the thickness of the product in mm).

10. A structural member suitable for the construction of aircraft wherein said structural member is used in wing ribs, spars and frames, comprising the product according to claim 1.

11. An extruded, rolled and/or forged aluminum-based alloy product having a thickness of at least 25 mm consisting essentially of (in weight %):

Zn 6.70-7.40
Mg 1.50-1.80
Cu 2.35-2.55, wherein the Cu to Mg ratio is at least 1.30, wherein Cu+Mg is at least 3.8
wt. %,
Zr 0.04-0.14
Mn 0.2-0.5
Ti 0-0.15
V 0-0.15
Fe 0-0.15
Si 0-0.15
impurities ≤0.05 each and ≤0.15 total
and the balance aluminum
wherein said product has the following properties:

a) minimum life without failure after Environmentally Assisted Cracking (EAC) under conditions of high stress, at a short transverse (ST) stress level of 80% of the product tensile yield strength in ST direction, and humid environment with 85% relative humidity at a temperature of 70° C., of at least 30 days,
b) conventional tensile yield strength measured in the L direction at quarter thickness of at least 515-0.279*t MPa (t being the thickness of the product in mm),
c) $K_{1C}$ toughness in the L-T direction measured at quarter thickness of at least 42-0.1 t MPa√m (t being the thickness of the product in mm).

12. The product according to claim 11 wherein the thickness thereof is from 50 to 150 mm.

13. An extruded, rolled and/or forged aluminum-based alloy product having a thickness of at least 25 mm consisting of (in weight %):

Zn 6.70-7.40
Mg 1.50-1.80
Cu 2.35-2.55, wherein the Cu to Mg ratio is at least 1.30, wherein Cu+Mg is at least 3.8 wt. %,
Zr 0.04-0.14

Mn 0.2-0.5
Ti 0-0.15
V 0-0.15
Fe 0-0.15
Si 0-0.15
impurities ≤0.05 each and ≤0.15 total
and the balance aluminum,
wherein said product has the following properties:

a) minimum life without failure after Environmentally Assisted Cracking (EAC) under conditions of high stress, at a short transverse (ST) stress level of 80% of the product tensile yield strength in ST direction, and humid environment with 85% relative humidity at a temperature of 70° C., of at least 30 days,
b) conventional tensile yield strength measured in the L direction at quarter thickness of at least 515-0.279*t MPa (t being the thickness of the product in mm),
c) $K_{1C}$ toughness in the L-T direction measured at quarter thickness of at least 42-0.1 t MPa√m (t being the thickness of the product in mm).

14. The product according to claim 13 wherein the thickness thereof is from 50 to 150 mm.

15. A process for manufacture of an extruded, rolled and/or forged aluminum-based alloy product comprising:

a) casting an ingot comprising, (in weight-%)
Zn 6.70-7.40
Mg 1.50-1.80
Cu 2.35-2.55, wherein the Cu to Mg ratio is at least 1.30, wherein Cu+Mg is at least 3.8 wt. %,
Zr 0.04-0.14
Mn 0.2-0.5
Ti 0-0.15
V 0-0.15
Fe 0-0.15
Si 0-0.15
impurities ≤0.05 each and ≤0.15 total
and the balance aluminum, wherein the alloy product does not contain Cr,
b) homogenizing the ingot or billet
c) hot working said homogenized ingot or billet to an extruded, rolled and/or forged product with a final thickness of at least 25 mm;
d) solution heat treating and quenching the product;
e) stretching the product;
f) artificial aging, wherein said product has the following properties:

a) minimum life without failure after Environmentally Assisted Cracking (EAC) under conditions of high stress, at a short transverse (ST) stress level of 80% of the product tensile yield strength in ST direction, and humid environment with 85% relative humidity at a temperature of 70° C., of at least 30 days,
b) conventional tensile yield strength measured in the L direction at quarter thickness of at least 515-0.279*t MPa (t being the thickness of the product in mm),
c) $K_{1C}$ toughness in the L-T direction measured at quarter thickness of at least 42-0.1 t MPa√m (t being the thickness of the product in mm).

16. The process according to claim 15 wherein equivalent aging time t(eq) is comprised between 8 and 30 hours, the equivalent time t(eq) at 155° C. being defined by formula:

$$t(eq) = \frac{\int \exp(-16000/T)dt}{\exp(-16000/T_{ref})}$$

where T is the instantaneous temperature in ° K during annealing and $T_{ref}$ is a reference temperature selected at 155° C. (428° K)·t(eq) is expressed in hours.

17. The process according to claim 15 wherein hot working entry temperature is comprised from about 380 to about 460° C.

18. The process according claim 15 wherein the solution heat treatment temperature is from 460 to about 510° C.

19. The process according to claim 15, comprising casting an ingot consisting essentially of (in weight %)
Zn 6.70-7.40
Mg 1.50-1.80
Cu 2.35-2.55, wherein the Cu to Mg ratio is at least 1.30, wherein Cu+Mg is at least 3.8
wt. %,
Zr 0.04-0.14
Mn 0.2-0.5
Ti 0-0.15
V 0-0.15
Cr 0
Fe 0-0.15
Si 0-0.15
impurities ≤0.05 each and ≤0.15 total, and
wherein the alloy product does not contain Cr.

* * * * *